United States Patent [19]

Adams et al.

[11] Patent Number: 4,664,608

[45] Date of Patent: May 12, 1987

[54] ROTARY COMPRESSOR WITH REDUCED FRICTION BETWEEN VANE AND VANE SLOT

[75] Inventors: Glen O. Adams; Gerald E. Sturgeon; Gary O. Scheldorf, all of Louisville, Ky.

[73] Assignee: General Electric Company, Louisville, Ky.

[21] Appl. No.: 852,097

[22] Filed: Apr. 14, 1986

Related U.S. Application Data

[63] Continuation of Ser. No. 794,685, Nov. 4, 1985, abandoned.

[51] Int. Cl.[4] ..... F04C 18/356; F04C 29/10; F04B 39/00

[52] U.S. Cl. ..... 418/63; 418/249; 417/299; 417/310

[58] Field of Search ..... 417/283, 284, 299, 310; 418/63, 65, 251, 249

[56] References Cited

U.S. PATENT DOCUMENTS

| | | | |
|---|---|---|---|
| 1,504,926 | 8/1924 | Baisch | 418/248 X |
| 1,623,378 | 4/1927 | Bavington | 418/65 |
| 2,153,371 | 4/1939 | Hubacker . | |
| 2,155,756 | 4/1939 | Firestone et al. . | |
| 2,721,026 | 10/1955 | Dills . | |
| 2,883,101 | 4/1959 | Kosfeld . | |
| 3,007,419 | 11/1961 | Burt . | |
| 3,139,036 | 6/1964 | McGill | 418/63 X |
| 3,238,885 | 3/1966 | Paski . | |
| 3,469,500 | 9/1969 | Lutz et al. | 91/121 |
| 3,767,328 | 10/1973 | Ladusaw | 417/299 X |
| 3,813,193 | 5/1974 | Rinehart | 418/63 |

*Primary Examiner*—John J. Vrablik

*Attorney, Agent, or Firm*—F. P. Giacalone; Radford M. Reams

[57] ABSTRACT

A hermetically sealed rotary refrigerant compressor, comprising a compression chamber, a roller eccentrically rotatable in the chamber, and a vane slidably mounted in a slot in the wall of the chamber dividing the chamber between a low pressure suction side and a high pressure compression side including means for modulating the pressure differential between the low pressure suction side and the high pressure compression side of the vane at a preselected time in the compression cycle so as to minimize the frictional forces between the vane and vane slot caused by the pressure differential in the chamber.

1 Claim, 12 Drawing Figures

FIG. 10
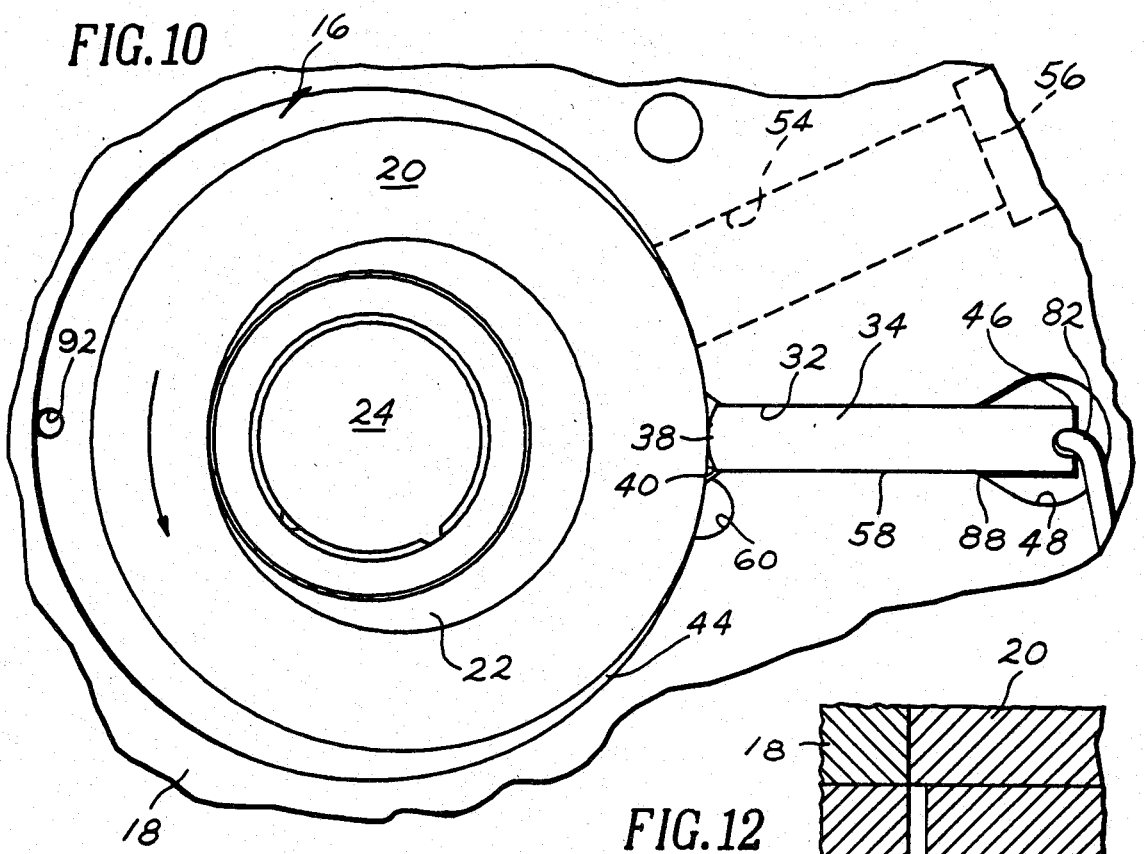
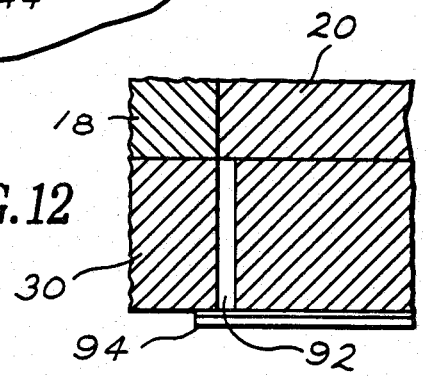
FIG. 12
FIG. 11
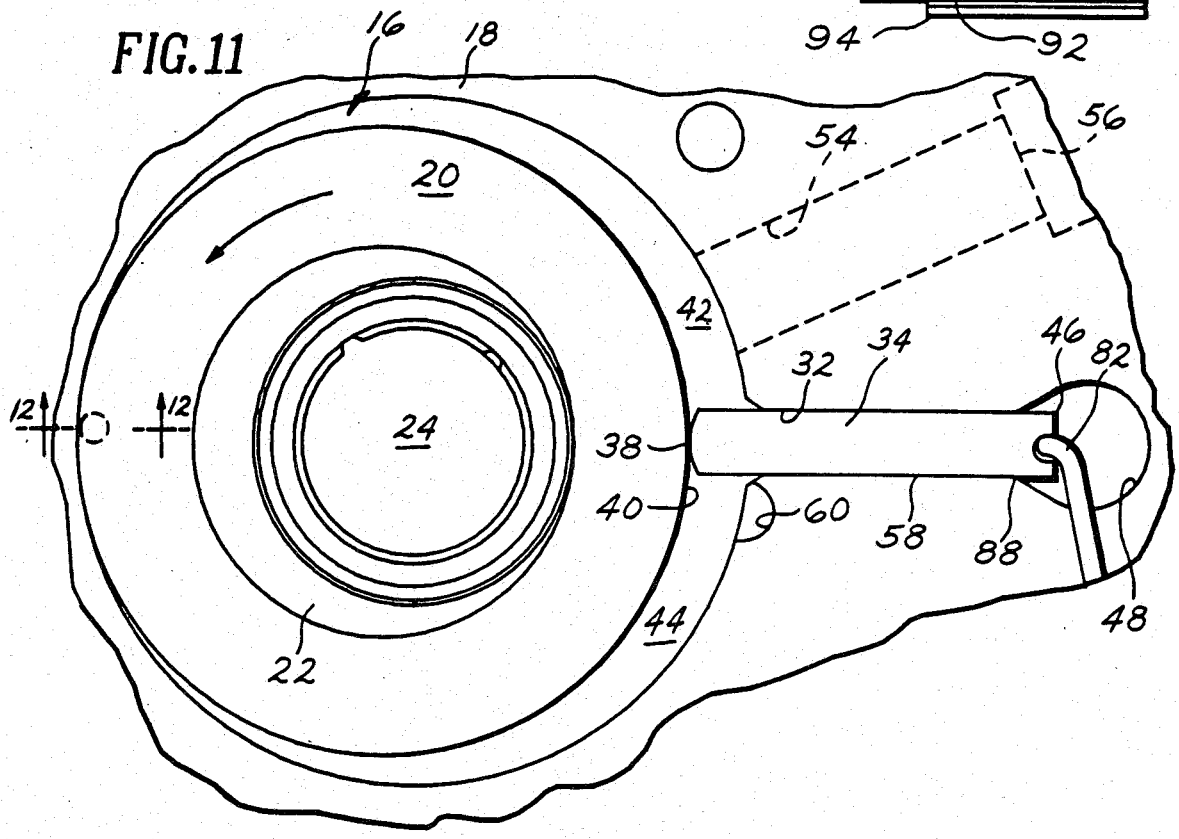

ROTARY COMPRESSOR WITH REDUCED FRICTION BETWEEN VANE AND VANE SLOT

This application is a continuation of application Ser. No. 794,685, filed 11/4/85, now abandoned.

BACKGROUND OF THE INVENTION

A well known type of hermetically sealed rotary compressor for refrigeration systems comprises a hermetic casing containing a compressor consisting of a cylindrical wall member and end plates defining a compression chamber, a roller eccentrically mounted within the chamber and a vane slidably mounted within a vane slot provided in the cylinder wall. The inner radial edge of the vane engages the periphery of the rotor to divide the chamber into a high pressure side and a low pressure side. The vane is biased against the roller by a spring. In the operation of such a compressor, rotation of the roller draws gas into the low pressure side and discharges the compressed gas through a discharge port communicating with the high pressure side. The discharge port is valved to the interior of the casing, which accordingly, during compressor operation is maintained at the relatively high discharge pressure. The high pressure gas in the casing acting on the outer radial end of the vane assists the spring in maintaining the inner radial end of the vane against the roller during compressor operation. During the operation of a compressor of this type, there is a considerable side force exerted on the vane or, more specifically, the portion thereof extending into the compression chamber, due to the fact that one side or face of the vane is exposed to high or discharge pressure and the other to low or suction pressure. This side force exerted on the vane portion extending into the compression chamber causes a friction force which inhibits the motion of the vane in the slot. This frictional force is sufficient that it will prevent the vane from following the roller to bottom dead center during compressor start up when the pressure in the case is not high enough to assist the spring in overcoming the frictional forces and maintaining the vane against the roller. Accordingly, it is possible during compressor start up for the vane to separate from the roller and not be in continuous contact as the roller moves from top to bottom dead center position. When the vane does separate from the roller continued rotation of the roller from the bottom to top dead center will cause it to strike the vane, thereby creating an objectionable noise. This frictional force on the vane is critical only during start up of the compressor since once the hermetic case reaches operating conditions the pressure in the case acting on the outer end of the vane is sufficient together with the spring to overcome the frictional forces and maintain the vane against the roller through the continuous rotation of the roller. The result of the frictional forces is a noise which is present only during compressor start up.

SUMMARY OF THE INVENTION

It is a general object of the present invention to provide means for modulating refrigerant pressure available within the compressor to counteract the side force on the vane during start up of the compressor to insure continuous contact between vane and roller.

In accordance with the illustrated embodiment of the present invention, there is provided a rotary refrigerant compressor contained in a hermetic casing and including end plates and a cylindrical wall defining an annular compression cylinder. A roller is eccentrically rotatable within the cylinder. Spaced suction and discharge ports communicate with the cylinder and a vane slidably mounted in a slot provided in the cylinder side walls divide the cylinder into a low and high pressure side or chambers. In order to reduce vane sticking in the slot during compressor start up due to frictional forces caused by the pressure differential between the high and low side chambers, means operable at a preselected time during the compression cycle are provided which reduces the pressure differential between the low and high pressure chambers an amount sufficient to overcome the frictional forces and thereby allow the vane to remain in continuous contact with the roller.

BRIEF DESCRIPTION OF THE DRAWINGS

FIG. 10 is an enlarged view of a portion of the compressor of FIG. 4 showing still another embodiment of the invention;

FIG. 11 is an enlarged view of a portion of the compressor shown in FIG. 10 showing the compressor roller in a rotated position; and FIG. 12 is a fragmentary sectional view taken along line 12—12 of FIG. 11.

DESCRIPTION OF THE PREFERRED EMBODIMENT

Figure 1:
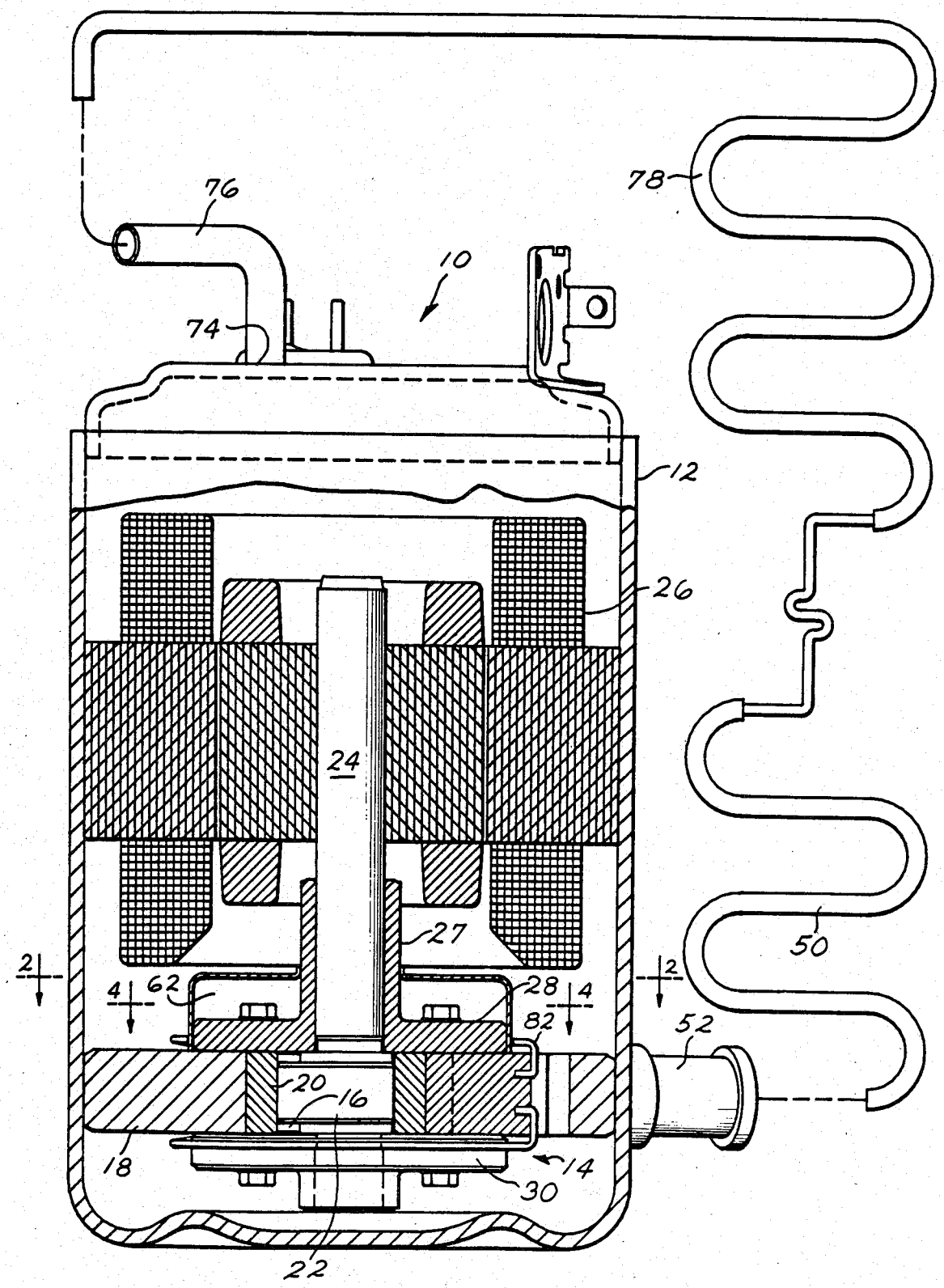
FIG. 1 is a cross-sectional view of a rotary compressor embodying the present invention including a schematic of a refrigerator system.

Referring to FIG. 1, there is shown a hermetic compressor 10 including a hermetic casing 12 in which there is disposed a refrigerant compressor unit 14 having an angular chamber or compressor chamber 16 (FIGS. 4, 5) defined within a cylinder 18. Disposed for rotation within the chamber 16 is a roller 20 which is driven by an eccentric 22 formed as an integral part of the drive shaft 24 extending downwardly from the motor 26. A hollow bearing journal 27 formed in the supporting main frame 28, supports the shaft 24 above the eccentric 22 for rotation by the motor 26. It should be noted that the main frame 28 provides the upper end wall enclosing the angular compressor chamber 16. The opposite or lower end wall 30 encloses the bottom of the compressor chamber 16 and also supports the lower end of the shaft 24. Cylinder 18, welded to the casing 12, supports the compressor unit 14 within the hermetic casing 12.

Figure 4:
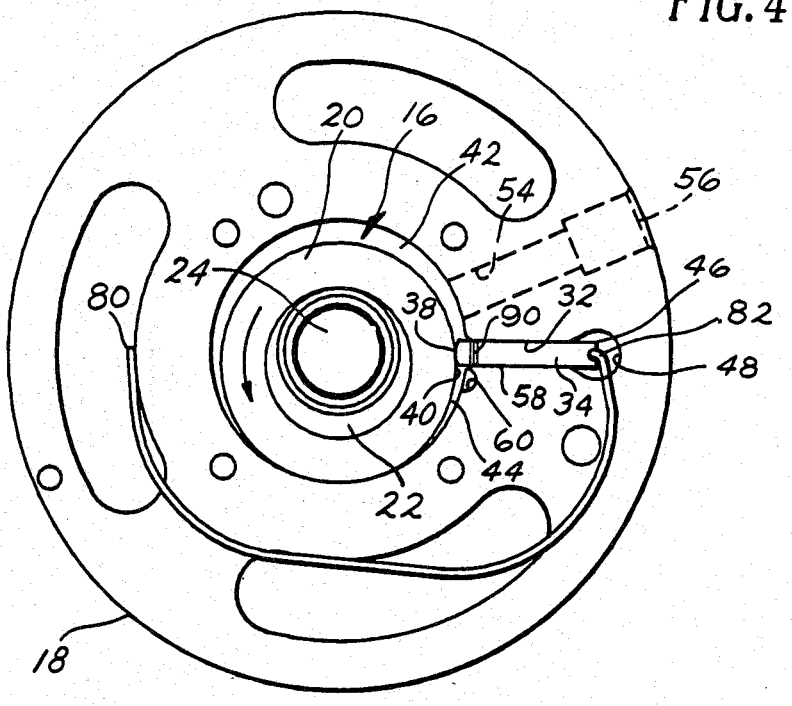
FIG. 4 is a top plane view of a portion of the rotary compressor embodying the invention taken along line 4—4 of FIG. 1.

As may best be seen in FIGS. 4 and 11, the cylinder 18 is provided with a radial vane slot 32 having slidably disposed therein a blade or vane 34. The vane 34 is biased by a spring 36 so that its radial inner end 38 is in engagement with the peripheral surface 40 of the roller 20 thereby dividing the chamber 16 into a low and high pressure side designated as 42 and 44 respectively. The outer end portion 46 of the vane 34 is positioned in an opening 48 formed in the cylinder 18 so as to be exposed to the interior of the casing 12. As shown in FIGS. 4, 5, 7, 8, 10 and 11, the shaft 24 and therefore the eccentric 22 and roller 20 are rotatable in a counter clockwise direction as indicated by the arrow.

With reference to FIG. 1, the hermetic compressor 10 is shown connected into a refrigeration system to receive suction or low pressure gas from an evaporator 50 through a suction line 52. Means are provided for delivering the suction gas into the low pressure side 42 of the chamber 16 from the suction line 52. More specifically, referring to FIGS. 2 and 4, these means include a channel 54 having an inlet area 56 formed or bored through the side of the cylinder 18 and communicating with the compressor chamber 16. The inlet area 56 delivers low pressure gas into the low pressure side 42 of the compression chamber 16 where it is compressed between the peripheral surface 40 of the roller 20, the sides of the angular chamber 16, and the high pressure side 58 of the vane 34, during rotation of the roller 20 around the chamber.

As best seen in FIGS. 1–11, means, including a discharge port 60 and discharge chamber 62, (FIG. 1) are provided for discharging the high pressure gas from the high pressure side 44 of the angular chamber 16 into the hermetic casing 12. Mounted within the discharge chamber 62 is a suitable valve 64 (FIGS. 2 and 3) for assuring proper compression of the gas issuing through the discharge port 60 and preventing reverse flow of gas back into the compressor chamber 16. The valve 64 (FIG. 3) has on top of it a valve spring 66 that is spring biased in the direction of the valve 64 to close the valve once the high pressure gas is exhausted from the high pressure side 44 of the chamber 16. Above or overlying the valve spring 66 is a rigid valve stop 68 that acts to prevent excess upward movement of the valve 64 and valve spring 66 during exhausting of the high pressure gas. All of these components 64, 66 and 68 are secured to the main frame 28 by a bolt 70.

The high pressure exhaust gas passing through the discharge port 60 enters the discharge chamber 62. The discharge chamber 62 acts as a muffler and is utilized to reduce noise of the high pressure gas passing from the compressor unit 14 into the compressor casing 12. In operation then as the high pressure gas is exhausted from the compressor unit through the discharge port 60, it passes through the discharge port 60 by raising the valve 64 and allowing the gas to pass into the interior of the casing 12. After flowing upwardly over the motor 26 the high pressure gas is conducted out of the hermetic casing 12 through a suitable discharge means or outlet 74 in the upper end of the case and through a discharge line 76 shown in FIG. 1 into the condenser 78 where the heat absorbed by the refrigerant in the other portions of the system is abstracted. As the gas in the condenser 78 is cooled it condenses so that the refrigerant in the latter stage of the condenser is therefore largely in liquid form.

Figure 2:
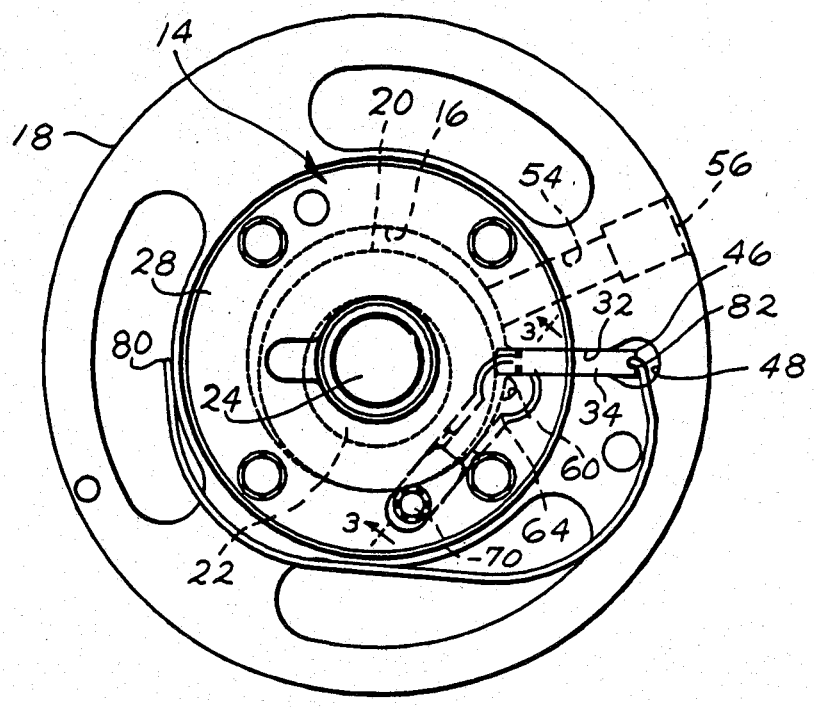
FIG. 2 is a top plane view of a portion of the rotary compressor shown in FIG. 1 taken along line 2—2 of FIG. 1.
Figure 3:
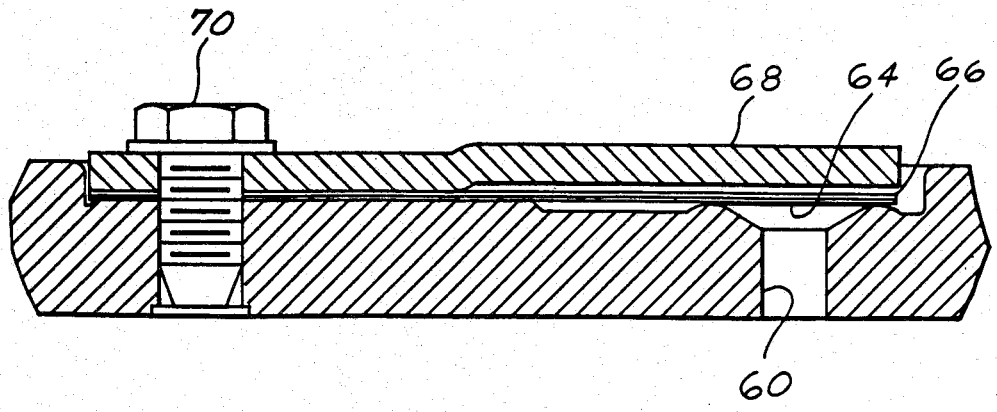
FIG. 3 is fragmenting sectional view taken along line 3—3 of FIG. 2.

In order to prevent leakage of high pressure refrigerant from the high side 44 to the low side 42 during rotation of the roller 20 in a counterclockwise direction as viewed in FIG. 2. it is necessary that the forward edge of the vane 34 be maintained in continuous sealing engagement with the periphery of the roller regardless of the position of the roller within the chamber 16. This requires that during each revolution of the roller, the vane must reciprocate between a forward position in which the vane 34 extends into the compression chamber 16 as illustrated in FIGS. 5, 8 and 11 of the drawing, and a fully retracted position (FIGS. 7 and 10) in which the forward edge of the vane is substantially flush with the cylindrical compressor wall.

The means for maintaining the vane 34 in engagement with the roller 20 includes the spring 36 which as shown in FIGS. 2 and 4 is generally C-shaped. The spring includes two C-shaped portions 36 positioned above and below the cylinder 18 as shown in FIG. 1. One end 80 (FIGS. 2 & 4) interconnecting the two C-shaped sections is positioned in the main frame 28 at a location generally located 180° from the vane 34 and the other end 82 engaged with the outer end 46 of the vane 34 for movement therewith. Thus the spring 36 is retained in a position to effectively maintain the forward edge of the vane 34 in constant contact with the peripheral surface of the roller 20 during the operation of the compressor. As seen in FIG. 1, the spring 36 as assembled is arranged with the C-shaped sections perpendicular to the axis of the shaft 24. With this arrangement, the force of the spring 36 and the outer edge of the vane 34 is directly on the center of the axial dimension of the vane so that equal force is exerted beteen the outer surface of roller 20 and the entire contacting inner surface of the vane 34. As mentioned above, the outer end 46 of the vane 34 is arranged in an opening 48 provided in the cylinder 18. The opening 48 as mentioned above is exposed to the pressure in the casing 12. Accordingly, during operation of the compressor the relatively high pressure refrigerant gas (220 PSI) in the compressor casing acting on the outer radially disposed end of the vane assists the spring 36 in maintaining the forward end 38 of the vane 34 in constant contact with the roller 20.

Figure 5:
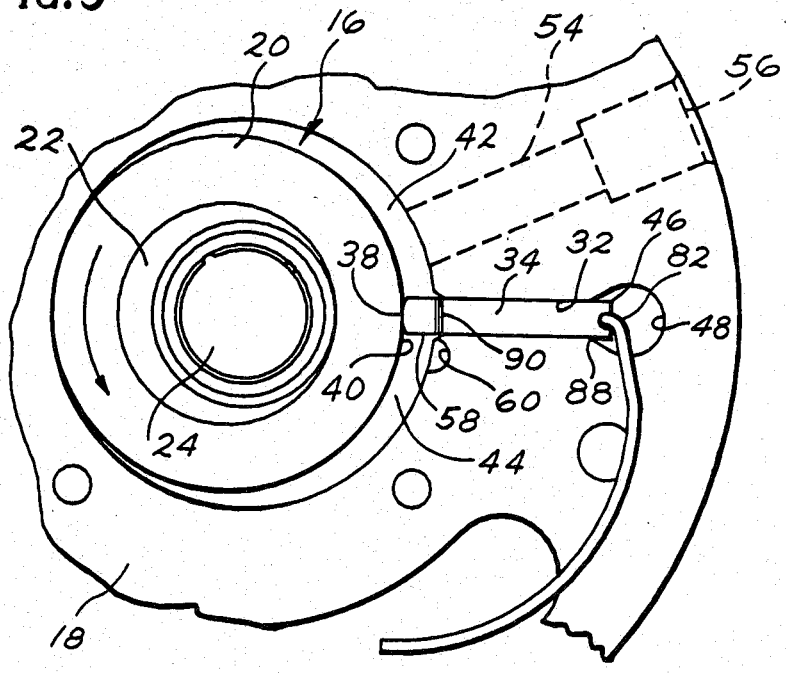
FIG. 5 is an enlarged view of a portion of the compressor shown in FIG. 4 showing the compressor roller in a rotated position.
Figure 8:
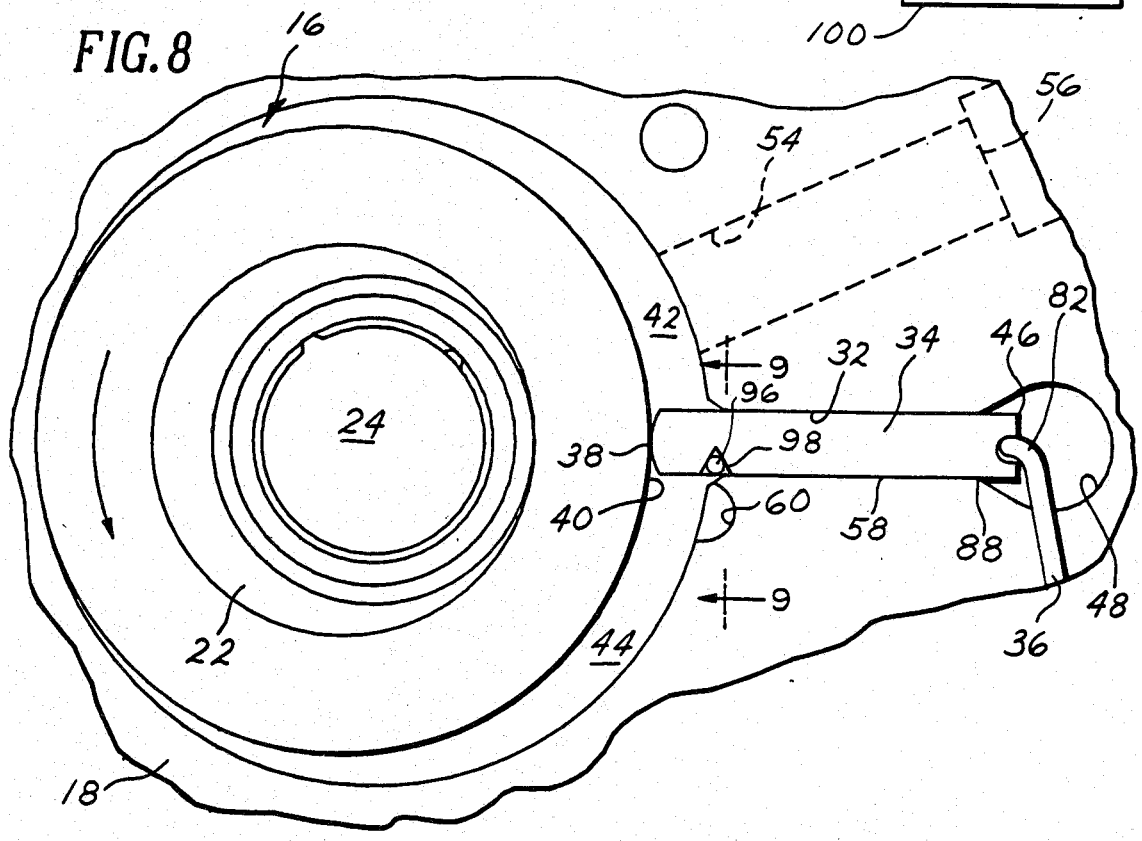
FIG. 8 is an enlarged view of a portion of the compressor shown in FIG. 7 showing the compressor roller in a rotated position.

During operation of the compressor, as for example, when the roller is in the position shown in FIGS. 5 and 8 of the drawing in which the vane 34 extends into the compression chamber 16, the side or face 58 of the vane 34 is subjected to the high pressure of refrigerant gas being compressed in the chamber 16 while the other face of the vane 34, indicated by the numeral 38*a*, is exposed to low or suction pressure. This pressure differential on the vane 34 exerts a lever action on the vane biasing the exposed portion of the vane in the clockwise direction while the rotation of the roller 20 is in the counter clockwise direction. This results in points of maximum frictional force between the vane and slot. These reaction points being adjacent inner end 86 of the slot side wall on the suction or low pressure side of the vane and at the outer end 88 of the vane slot wall on the high pressure side of the vane. The frictional force and vane slot wear is at its maximum at these reaction points or areas 86 and 88. This frictional force created by the pressure differential between the low and high pressure sides of the chamber 16 will cause the interior end 38 of the vane 34 to separate from its contact with the roller 20 when the roller is at bottom dead center position shown in FIGS. 5, 8 and 11. This phenomenon occurs during initial start up of the compressor because at this time the pressure in the casing 12 is not high enough to exert sufficient pressure on the outer end 46 of the vane to assist the spring 36 in overcoming the frictional force described above. It has been determined that the end 38 of vane 34 separates from the roller surface 40 at approximately between 140° and 160° before bottom dead center, and the pressure differential between the high and low side of the vane is between 15 to 25 psi. Contact between the roller and vane is re-established at approximately between 185° and 200° past dead center. The impact between the roller surface 40 and the end 38 of the vane when contact is re-established causes an objectionable start up noise which may continue for several seconds of initial operation or until the casing pressure exerts a force on the vane which is sufficient to overcome the frictional forces described above.

In accordance with the present invention, the frictional forces in these areas 86 and 88 are reduced by providing means for counteracting this gas pressure differential on the vane within the vane slot. Referring to FIGS. 10–12 in the preferred embodiment of the invention shown therein there is provided a pressure relief port 92 extending through the lower end wall 30. The port 92 forms a passageway which communicates between the chamber 16 and the interior of the casing 12. The port 92 opens into chamber 16 at a location approximately 140° before bottom dead center and 190° past bottom dead center from the vane 34. A spring valve 94 mounted over the opening of port 92 is designed so that the relatively high pressure in the casing 12 during normal operation of the compressor will maintain port 92 closed. In effect, valve 94 is designed so as to permit discharge of refrigerant gas from the chamber 16 into casing 12 only during start up of the compressor when the compressor case has not reached its operating pressure of approximately 220 psi. It has been determined that when the pressure differential is lowered from between 15 and 25 psi to approximately 5 to 15 psi the frictional forces will be lowered sufficiently so that the vane 34 will move freely in the slot 32 and accordingly the end 38 of vane will follow the roller 20 during start up and remain in constant contact with the roller.

Figure 7:
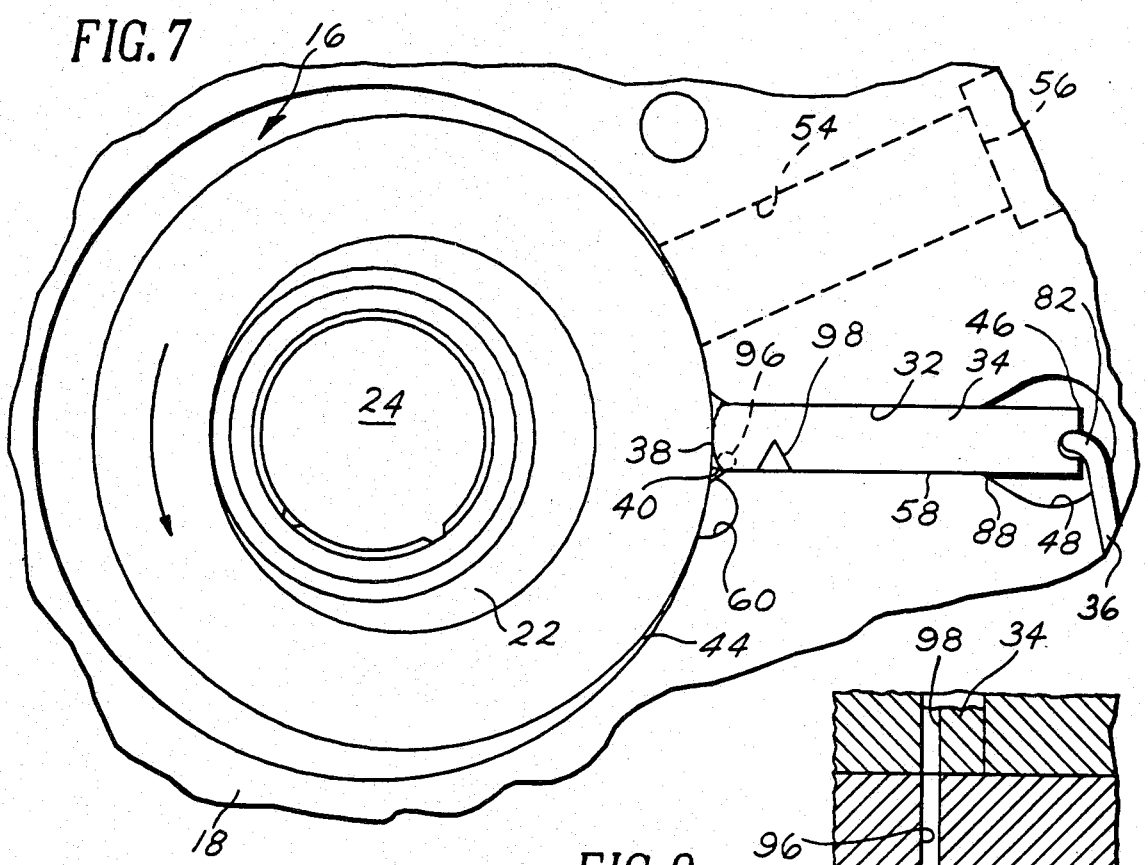
FIG. 7 is an enlarged view of a portion of the compressor of FIG. 4 showing another embodiment of the invention.
Figure 9:
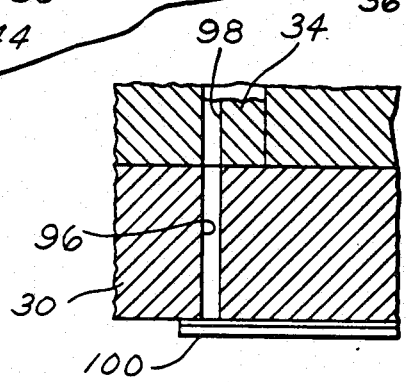
FIG. 9 is a sectional elevational view taken along line 9—9 of FIG. 8.

With reference to the embodiment shown in FIGS. 7–9, the relief port 96 communicating between the high pressure side 44 of chamber 16 and the interior of the casing 12 is located and dimensioned to underlie the vane 34. The vane side wall exposed to the high pressure side 44 of chamber 16 is formed to include a notch or cut out 98 which is located so as to align with the port 96 as shown in FIG. 8 when the roller 20 is between approximately 140° before bottom dead center and 190° past bottom dead center from the vane position. The notch 98 is dimensioned as shown in FIG. 8 so that it is exposed to the chamber 16 when the roller is between 140° before bottom dead center and 190° past bottom dead center. In this instance, the vane 34 functions as the valve member and refrigerant gas is discharged from chamber 16 when the notch 98 aligns with the port 96. Like the embodiment shown in FIGS. 10–12, a spring valve 100 may be mounted over port 96 so as to insure that case pressure during normal operation of the compressor will maintain port 96 closed. In effect, valve spring 100 like valve spring 92 will permit discharge of refrigerant gas from the chamber 16 only during start up of the compressor when the compressor case has not reached its operating pressure.

Figure 6:
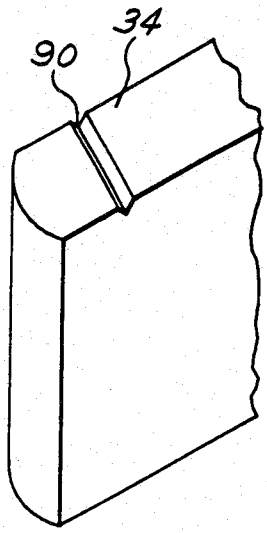
FIG. 6 is an enlarged perspective view of the vane employed in the rotary compressor of FIGS. 4 and 5.

In still another embodiment of the present invention the means for counteracting this initial pressure differential includes a groove 90 formed in the upper surface of the vane 34 as shown in FIGS. 4–6. The location of the groove 90 is such that the groove is positioned in the compression chamber and accordingly a passageway provided between the high side 44 and low side 42 when the roller is at approximately 10° on either side of bottom dead center as shown in FIG. 5.

In summary, by providing means to lower the pressure differential between the high and low side 42, 44, respectively, the frictional forces between the vane and vane slot have also been lowered to a degree that the vane will remain in contact with the roller during the initial cycles of operation of the compressor. The application of this invention has in fact provided an economical and practical solution to start up noise in a rotary compressor. It should be understood that the present invention including the above described parameters were successfully reduced to practice in a refrigeration rotary compressor having a rated BTU rating of between 800 and 1200 and the employment of compressors having other capacity in carrying out the present invention may require other parameters.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A rotary gas compressor contained in a hermetic casing comprising:

means including a cylindrical wall defining an annular compression cylinder;

a roller eccentrically rotatable within said cylinder through a compression cycle, spaced suction and discharge ports communicating with said cylinder;

a radially extending slot in said cylindrical wall between said ports and including spaced side walls;

a vane slidably mounted in said slot and having its outer radial end exposed to said hermetic casing and the inner radial end engaging said roller to divide said cylinder into low and high pressure chambers within said cylinder;

said suction port communicating with said low pressure side of said vane for drawing gas into said cylinder and said discharge port communicating with said high pressure side of said vane for discharging high pressure compressed gas into said hermetic casing, whereby the difference in gas pressure on the opposite faces of said vane exerts forces on said vane concentrating friction between the vane and vane slot walls positioned in said low pressure chamber;

means for reducing said concentration of friction between said vane and vane slot walls positioned in said high pressure chamber including a passageway having one end communicating with said casing and its other end communicating with said cylinder at a position so as to be covered by said vane; a notch in said vane positioned so as to align with said passageway at a predetermined time during said compression cycle to vent a portion of said high pressure gas from said high pressure chamber to said casing to thereby reduce the pressure between said chambers.

* * * * *